United States Patent [19]

Golden et al.

[11] Patent Number: 5,046,730

[45] Date of Patent: Sep. 10, 1991

[54] GOLF TEE

[75] Inventors: Casey V. Golden, Evergreen; Ronald L. Turner, Golden; John A. Elverum, Elizabeth; Ray L. Hauser, Boulder, all of Colo.

[73] Assignee: Bio Dynamics, Ltd., Golden, Colo.

[21] Appl. No.: 624,849

[22] Filed: Dec. 10, 1990

[51] Int. Cl.[5] ..... A63B 57/00

[52] U.S. Cl. ..... 273/33

[58] Field of Search ..... 273/33, 202–212

[56] References Cited

U.S. PATENT DOCUMENTS

| | | | |
|---|---|---|---|
| 1,850,560 | 3/1932 | Middendorf | 273/33 |
| 3,884,479 | 5/1975 | Gordos | 273/212 |
| 3,914,900 | 10/1975 | Bigelow et al. | 47/9 |
| 4,014,541 | 3/1977 | Desmarais | 273/33 |
| 4,126,438 | 11/1978 | Pulli et al. | 71/3 |
| 4,909,508 | 3/1990 | Noland et al. | 273/33 |

*Primary Examiner*—Theatrice Brown

*Attorney, Agent, or Firm*—Greenlee and Assoc.

[57] ABSTRACT

A golf tee formed of a molded composition of matter comprising 30–90% by weight sugar, 20–50% by weight cellulosic fiber, 2–30% by weight water soluble polymer and 2–20% by weight liquid or solid plasticizer. The molded composition may further include turf treatment materials such as grass seed and fertilizers.

14 Claims, No Drawings

GOLF TEE

BACKGROUND OF THE INVENTION

1. Field of the Invention

This invention relates/to golf tees and more particularly, to golf tees formed of a composition which provides a tee which is rigid in a dry environment and which rapidly disintegrates and degrades in a wet environment.

2. Description of the Prior Art

Many different plastic and composite materials have been used for molding useful articles. Most commercial plastics are intentionally insoluble in water and slow to biodegrade. Water-soluble plastics have been used for many years in special applications. Some natural water-soluble gums such as gum arabic, xanthan and tragacanth gums have been used in food products to give a soft consistency. Some synthetic water-soluble polymers have been used as binders and as films. Polyvinyl alcohol, polyvinylpyrrolidone, polyethylene oxide and alkyl celluloses are examples of such materials. These polymers be fully water-soluble but they are slow to dissolve.

Fibrous materials with a high ratio of length to diameter have been used for reinforcing composites, and the fibers are most effective if they are strong in the long direction. Mineral fibers, such as glass and asbestos, have been used for many composites, but they are not biodegradable. Natural cellulose fibers, such as fibers from wood, cotton, sisal, and linen, provide the attributes of reinforcement and degradability. Viscose rayon is a synthesized cellulose fiber that provides these same attributes. Cellulose is known to be a biodegradable material, weakened but not dissolved by water, decomposed by ultraviolet light and attacked by microorganisms in the air and soil. Cellulosic fibers are particularly susceptible to such degradation by virtue of a large surface area per volume.

Golf tees are conventionally made of wood or a moldable plastic. Tees made of such materials must be removed from the driving tee areas of golf courses, where they are often allowed to lie after the golfer has completed a drive. Tees of wood and plastic, when broken during the drive, are unsightly, are a hazard during mowing when struck by a mower blade and can damage the blades. The tees, being effectively water insoluble, must be physically picked up.

Efforts have been made to develop golf tees which, are water soluble or degradable, and in some instances, are also beneficial to the turf. Such tees have been made of water-degradable and biodegradable materials, and often incorporate grass seed and fertilizers. A number of patents disclose such tees. U.S. Pat. No. 4,126,438, issued Nov. 21, 1978, to J. Bruno et al., discloses a disintegrable golf tee comprised of clay, grass seed and a soil conditioner, such as a fertilizer, insecticide, herbicide, fungicide, or larvacide. Humus may be added to the composition as an optional ingredient. The tee thus produced can be shattered upon impact with a club head or it can be impressed into the ground. In either event, it decomposes upon contact with moisture to impart beneficial properties to the grass and soil.

U.S. Pat. No. 4,014,541, issued Mar. 29, 1977 to A. Desmarais, discloses a golf tee composed of a water-soluble thermoplastic material having a fertilizer dispersed therein. The golf tee is produced by injection molding. U.S. Pat. No. 3,884,479 issued May 20, 1975 to A. Gordos, discloses a golf tee which will shatter or disintegrate when struck by the driver employed by the player. The golf tee has a ball support section formed of a plastic material and a shank formed from grass seed and a water soluble binder. The shank is provided with a centrally located elongated rigid reinforcing member. U.S. Pat. No. 4,909,508, issued Mar. 20, 1990 to P. Franshan et al., discloses a golf tee made from peat moss admixed with a water soluble lignosulphonate binder in an amount sufficient to bond the peat moss together in a coherent and rigid body by cold or hot pressure forming.

OBJECTS AND SUMMARY OF THE INVENTION

The principal object of the present invention is to provide an improved degradable golf tee. More specifically, it is an object of the invention to produce a melt moldable, water degradable, biodegradable golf tee.

Another object of the present invention is to provide a golf tee of the foregoing character which is readily insertable into the ground at a golf driving tee area, and which, whether it remains on the surface or in the ground, rapidly disintegrates and decomposes after being broken.

A further object of the present invention is to provide a golf tee of the foregoing character which is competitive in strength and economics with conventional wooden and plastic tees.

A further object of the present invention is to provide a golf tee which is made of readily available, non-polluting materials.

Still a further object of the invention is to provide a golf tee which is degradable but has the look and feel of a conventional wooden or plastic tee.

Other objects and advantages of the present invention will become apparent as the following description proceeds.

SUMMARY

In accordance with the foregoing objects, the present invention comprises a golf tee produced from a composition which disintegrates in the presence of moisture and decomposes or degrades to produce components which are inert or beneficial to the turf. The composition embodying the present invention involves a binder, preferably formed of a sugar, such as sucrose, dextrose or fructose which can be melted in the temperature range 120°-175° C. Water soluble, synthetic polymers such as polyvinylpyrrolidone or a hydroxyalkyl cellulose may be utilized together with fibers of cellulosic or mineral materials. The compositions are mixed and molded into the shape of a golf tee and may be coated with a lacquer or similar material to reduce the stickiness of the surface. The moldable composition generally comprises 30-98% by weight sugar due to 50% by weight cellulosic or related fiber due to 30% by weight synthetic water soluble polymer and due to 20% by weight liquid or solid plasticizer. The composition is molded into a golf tee which has sufficient strength and rigidity to enable it to be inserted into the ground and support a golf ball and yet, after being used and broken biodegrades in the presence of moisture.

DESCRIPTION OF THE PREFERRED EMBODIMENTS

The golf tee embodying the present invention is produced by molding a composition of a meltable, water-soluble binder with biodegradable reinforcing fibers to produce a composite material in the shape of a tee. The preferred binders include sugars, specifically sucrose, dextrose, or fructose that can be melted in the temperature range of 120°-175° C. The binder phase may include water-soluble synthetic polymers such as polyvinylpyrrolidone or a hydroxyalkyl cellulose. The preferred fibers include cellulosic materials from wood pulp, cotton, linen, viscose rayon and sisal materials. Peat moss, a partially decomposed wood pulp, is also a suitable reinforcing fiber.

The fibers and binders are mixed together using a water solution. Alternatively, they can be mixed when the binder is melted. Intimate mixing and uniform distribution of fibers is important to the efficiency of the composite system. If water is used to facilitate mixing, most of it must be cooked out of the system to provide a melt-moldable mixture.

Plasticizers of liquid or solid nature may be incorporated in the system. Propylene glycol is a useful material which serves to decrease melt viscosity and to add toughness to the composite material. Polyethylene glycol and polypropylene glycol are useful for the same function. Polyethylene oxide and polyvinylpyrrolidone add some toughness to the product as a solid polymers.

The following examples illustrate the present invention.

EXAMPLE 1

A mixture of peat moss, cooked applesauce and grass seed was prepared using approximately the following formula:

| | |
|---|---|
| peat moss | 75% by weight |
| cooked applesauce | 8% by weight |
| lawn fertilizer | 5% by weight |
| grass seed | 2% by weight |
| biodegradable | 10% by weight |
| water/flour lunder | |

This mixture was hand-formed into the shape of a golf tee and dried in a microwave oven. The product was hard and strong, and useful as a golf tee.

EXAMPLES 2-10

The following compositions were prepared by mixing fibrous reinforcements in water solutions of the sugars, heating to dry the admixture, then injection molding into the shape of conventional golf tees:

EXAMPLE 2

| Component | Parts by Weight |
|---|---|
| sucrose | 70 |
| propylene glycol | 8 |
| wood pulp | 10 |
| water | 20 |

EXAMPLE 3

| Component | Parts by Weight |
|---|---|
| sucrose | 60 |
| polymer A | 9 |
| polymer C | 2 |
| propylene glycol | 6 |
| sisal fiber | 23 |
| water | 9 |

EXAMPLE 4

| Component | Parts by Weight |
|---|---|
| sugar solution B | 100 |
| polymer A | 8 |
| cotton fiber | 35 |
| water | 30 |

EXAMPLE 5

| Component | Parts by Weight |
|---|---|
| sucrose | 62 |
| sugar solution B | 13 |
| polymer A | 8 |
| polymer C | 2 |
| linen fiber | 35 |
| water | 60 |

EXAMPLE 6

| Component | Parts by Weight |
|---|---|
| sucrose | 62 |
| sugar solution A | 13 |
| polymer C | 2 |
| linen fiber | 23 |
| water | 60 |

EXAMPLE 7

| Component | Parts by Weight |
|---|---|
| sucrose | 62 |
| sugar solution B | 13 |
| polymer A | 8 |
| polymer C | 2 |
| cotton fiber | 35 |

EXAMPLE 8

| Component | Parts by Weight |
|---|---|
| sugar solution C | 100 |
| polymer A | 8 |
| wood pulp | 60 |

EXAMPLE 9

| Component | Parts by Weight |
|---|---|
| sucrose | 62 |
| sugar solution B | 13 |
| polymer A | 8 |
| polymer C | 2 |
| viscose rayon fiber | 35 |

-continued

| Component | Parts by Weight |
|---|---|
| water | 80 |

EXAMPLE 10

| Component | Parts by Weight |
|---|---|
| sucrose | 61.5 |
| sugar solution A | 13.4 |
| polymer B | 10.5 |
| polymer C | 1.6 |
| wollastonite | 9.2 |
| glass fiber | 3.8 |

Characteristics of the sugar solutions in these examples, and suitable commercial products are as set forth in Table I.

TABLE I

| Sugar Solution | % Solids | % Dextrose | % Fructose | Trade Name |
|---|---|---|---|---|
| A | 75 | 19 | 2 | Karo Light Corn Syrup Best Foods, CPC Int'l. Inc. |
| B | 71 | 52 | 42 | Biosweet 42, Coors BioTech Products Company |
| C | 77 | 41 | 55 | Biosweet 55, Coors BioTech |

Characteristics of the polymers in these examples are as set forth in Table II.

TABLE II

| Polymer | Chemistry | Molecular Weight | Trade Name |
|---|---|---|---|
| A | polyvinyl-pyrrolidone | 40,000 | PVP K-30, GAF Corp. |
| B | hydroxypropyl cellulose | 95,000 | Klucel LF. Aqualon Co. |
| C | polyethylene oxide | 600,000 | Polyox WSR204, Union Carbide Corporation |

The fibrous reinforcements used in these examples have the characteristics set forth in Table III.

TABLE III

| Fiber | Chemistry | % Water | Diameter | Length | Trade Name |
|---|---|---|---|---|---|
| wollastonite | calcium silicate | — | 3-64μ | 0.3-1.0 mm | NYAD |
| sisal | cellulose | 5-12 | 32-160μ | 1-4 mm | Sisal 310, Int.'l Filler |
| linen | cellulose | 5-12 | 14-18μ | 3-5 mm | Fibrolex 1392 Geo. Hermann |
| cotton | cellulose | 5-12 | 2-μ | 0.5-1 mm | D260 Cotton, Int.'l Filler |
| viscose rayon | cellulose | 5-12 | 3-5μ | 2-4 mm | Rayon C-15 Vertipile Inc. |
| wood pulp | cellulose | 50 | 2-4μ | 0.3-4 mm | recycled paper Ponderosa Pulp |

The sugar and fiber mixtures were heated at temperatures up to 165°-185° C. and were vacuum dried. These dried materials were injection molded at melt temperatures ranging from 135° to 175° C. into a mold shaped like a conventional wooden golf tee, having dimensions of 0.18 inch diameter through the shank, 2.25 inches long, and a 0.45 inch diameter head. Other configurations and dimensions may be utilized.

The molded golf tees were tested for flexural strength, compressive strength and impact strength. Flexural strength tests involved placing the shank on a span of one inch and loading the center of the span in the manner prescribed by ASTM D790-86, using a crosshead rate of 0.1 inch per minute. The maximum force was identified as flexural strength. Compressive strength was measured on some of the formulations, using a golf ball on top of a tee, with the tip constrained in an epoxy casting at the base. Maximum compressive force was measured in the manner of ASTM D695-89, using a crosshead rate of 0.1 inch per minute. The maximum force was identified as compressive strength. Impact strength was measured using an Izod impact testing machine as described in ASTM D256-88. The tee was tested without notching, with the head one inch above the vise of the testing machine. Energy was measured in inch-pounds.

Strengths of the above examples are listed in Table IV:

TABLE IV

| | Flexural Pounds | Compression Pounds | Impact, Inch-Pounds |
|---|---|---|---|
| Example 2 | 10.0 | 270 | 0.14 |
| Example 3 | 13.5 | 240 | 0.34 |
| Example 4 | 25.2 | — | 0.28 |
| Example 5 | 30.7 | 318 | 0.32 |
| Example 6 | 22.6 | — | 0.24 |
| Example 7 | 26.3 | — | 0.44 |
| Example 8 | 29.1 | — | 0.35 |
| Example 9 | 6.9 | 154 | 0.30 |

Some of these strengths compare favorably with natural wood tees having flexural strength in the range of 38-60 pounds, compressive strength in the range of 120 to 200 pounds, and impact strength in the range of 2.1 to 4.8 inch-pounds.

A sugar solution of composition #10 above was melted, and 25 strands of rayon fiber, 300 denier, were pulled through the melted sugars. When the material had cooled, the impregnated and coated fibers were tested for compression and impact strength. Compressive strength was measured at 138 pounds, and impact strength was measured at 2.0 inch-pounds. Cylindrical rods of the composite material were re-molded at one end to provide caps to hold golf balls in the conventional geometry of a golf tee.

Golf tees molded of some of these formulas were placed in beakers of water and the time required for dissolving was measured. Results are shown in Table V:

TABLE V

| Example | Dissolution Time/Hours |
|---|---|
| 2 | Less than three. |
| 3 | Less than three. |
| 4 | Less than three. |
| 5 lacquered | At 24 hours, softened, easily fragmented. |
| 6 | Less than 24. |
| 7 | Less than 24. |
| 8 | Less than 24. |
| 9 | Less than three. |

Mold spores may be added to hasten degradation. Sterilized grass seed may be added to attract birds. Insecticides may be added to avoid attracting ants to tees on the ground. The molded products may be coated with lacquer or other moisture resistant coatings to reduce surface stickiness and sensitivity to high humidity conditions. The lacquer used with example 5, Table 5, was an acrylic thermoplastic lacquer, one illustrative product being sold under the tradename "Krylon" spray. Other coatings which may be used to provide water barrier and non-sticky surface can include shellac, varnishes, alkyd enamels, urethane, epoxy, acrylic and optically cured coating materials. Flakey pigments such as mica and talc can be included in the coating to further decrease moisture effects on the tees prior to use. These lacquer coatings effectively retard degradation unless the tee is broken or lies in the open for a sufficient period of time to allow photo-degradation of the exterior lacquer coating to take place.

Further variations can include incorporation of blowing agents to make a dense foam which will quicken the rate of dissolution in water. Brown and green colorants can provide camouflage within the tee material. Swelling agents such as starch or bentonite can hasten the breakdown and the rate of dissolution, as can addition of soluble salts or fibers, e.g., potassium sulfate or ammonium sulfate. Fertilizers can also be added.

A natural fibrous sugar material, such as raw sugar cane, might be used as a raw material for this composite. Other ingredients of value may include natural gums, such as gum arabic and gelatin, rice hull, nutshell flour, chopped or milled glass fiber and other mineral fibers.

While certain illustrative examples of the present invention have been described in detail in the specification, it should be understood that there is no intention to limit the invention to the specific form and embodiments disclosed. On the contrary, the intention is to cover all modifications, alternatives, equivalents and uses falling within the spirit and scope of the invention as expressed in the appended claims.

We claim:

1. A golf tee having an elongated right shaft, said shaft having a concaved ball support first end and a pointed second end said tee being formed of a moldable composition comprising a fibrous material and a sugar base binder said composition having a dry mechanical strength sufficient to allow said tee to be inserted into the ground and to support a golf ball, and said composition being readily degradable upon exposure to moisture.

2. A golf tee as defined in claim 1 wherein said sugar base binder comprises a mixture of dextrose and fructose.

3. A golf tee as defined in claim 1 wherein said fibrous material comprises a fiber selected from the group consisting of sisal, linen, cotton, viscose rayon and wood.

4. A golf tee as defined in claim 1 wherein said fibrous material comprises a mineral fiber.

5. A golf tee as defined in claim 1 wherein said composition includes a grass treatment adjuvant.

6. A golf tee as defined in claim 1 wherein said composition includes grass seed.

7. A golf tee as defined in claim 1 wherein said composition includes a mineral filler.

8. A golf tee as defined in claim 1 including a moisture resistant coating thereon.

9. A golf tee as defined in claim 1 wherein said moldable composition comprises 30 to 98% by weight sugar and 2 to 50% by weight cellulosic fiber.

10. A golf tee as defined in claim 1 wherein said moldable composition comprises 50 to 95% by weight sugar, 2 to 30% by weight synthetic water-soluble polymer, and 10 to 50% by weight cellulosic fiber.

11. A golf tee as defined in claim 1 wherein said moldable composition comprises 50 to 95% by weight sugar, 10 to 50% by weight cellulosic fiber, and 2 to 20% by weight liquid or solid plasticizer.

12. A golf tee as defined in claim 1 wherein said moldable composition comprises 50 to 90% by weight sugar, 2 to 20% by weight synthetic water-soluble polymer, 10 to 50% cellulosic fiber, and 2 to 20% by weight liquid or solid plasticizer.

13. A golf tee as defined in claim 1 wherein said sugar base binder comprises applesauce.

14. A golf tee as defined in claim 13 wherein said composition includes grass seed.

* * * * *

UNITED STATES PATENT AND TRADEMARK OFFICE

CERTIFICATE OF CORRECTION

PATENT NO. : 5,046,730

DATED : September 10, 1991

INVENTOR(S) : Golden, Turner, Elverum and Hauser

It is certified that error appears in the above-identified patent and that said Letters Patent is hereby corrected as shown below:

At column 1, line 6, please rewrite "relates/to" as --relates to--.

At column 3, line 22, please rewrite "fibers is" as --fibers are--.

At column 3, line 33, please rewrite "as a" as --as--.

At claim 1, line 1, please rewrite "right" as --rigid--.

Signed and Sealed this

Nineteenth Day of January, 1993

*Attest:*

DOUGLAS B. COMER

*Attesting Officer*

*Acting Commissioner of Patents and Trademarks*